US006525480B1

(12) United States Patent
Hargus, Jr. et al.

(10) Patent No.: US 6,525,480 B1
(45) Date of Patent: Feb. 25, 2003

(54) LOW POWER, LINEAR GEOMETRY HALL PLASMA SOURCE WITH AN OPEN ELECTRON DRIFT

(75) Inventors: William A. Hargus, Jr., Lancaster, CA (US); Nathan B. Meezan, Birmingham, AL (US); Mark A. Cappelli, Mountain View, CA (US)

(73) Assignee: The Board of Trustees of the Leland Stanford Junior University, Stanford, CA (US)

( * ) Notice: Subject to any disclaimer, the term of this patent is extended or adjusted under 35 U.S.C. 154(b) by 350 days.

(21) Appl. No.: 09/606,847

(22) Filed: Jun. 28, 2000

Related U.S. Application Data

(60) Provisional application No. 60/141,565, filed on Jun. 29, 1999.

(51) Int. Cl.[7] ..... H01J 7/24

(52) U.S. Cl. ..... 315/111.21; 315/111.81; 315/111.41; 313/231.31; 250/423 R

(58) Field of Search ..... 315/111.21, 111.51, 315/111.81, 344, 500–505; 313/231.31, 231.41; 219/121.52; 250/423 R, 426

(56) References Cited

U.S. PATENT DOCUMENTS 5,075,594 A * 12/1991 Schumacher et al. ... 315/111.21
5,132,597 A * 7/1992 Goebel et al. ..... 315/111.41
5,751,113 A * 5/1998 Yashnov et al. ..... 315/111.21

OTHER PUBLICATIONS

Clyde O. Brown et al., "Further experimental investigations of a cesium hall–current accelerator," vol. 3, No. 5, May 1965, AIAA Journal, p 583.

G. S. Janes et al., "Anomalous electron diffusion and ion acceleration in a low–density plasma," The Physics of Fluids, vol. 9, No. 6, Jun. 1966, p 1115.

Frank S. Gulczinski III et al., "Analysis of hall–effect thrusters and ion engines for orbit transfer missions," AIAA–96–2973, 32$^{nd}$ Joint Propulsion Conference, Jul. 1–3, 1996, Lake Buena Vista, FL.

A. Guthrie, Ph. D. et al., "The Characteristics Of Electrical Discharges in Magnetic Fields," McGraw–Hill Book Company, Inc., New York, 1949.

Francis F. Chen, "Plasma physics and controlled fusion," 2$^{nd}$ Edition, Plenum Press, NY, p. 193, 1985.

(List continued on next page.)

*Primary Examiner*—Don Wong
*Assistant Examiner*—Jimmy T. Vu
(74) *Attorney, Agent, or Firm*—Lumen Intellectual Property Services, Inc.

(57) ABSTRACT

The operating characteristics of a linear geometry Hall plasma source scaled to operate in the 50 to 100 Watt power range are described. Two thruster acceleration channels are implemented-one of alumina and one of boron nitride. Differences in operation with the two channel materials are attributable to differences in the secondary electron emission properties. In either case, however, operation is achieved despite the lack of a closed electron current drift in the Hall direction, suggesting that there is an anomalous axial electron mobility, due to either plasma fluctuations or collisions with the channel wall. Strong low frequency oscillations in the discharge current, associated with the depletion of propellant within the discharge, are seen to appear and vary with changes in the applied magnetic field strength. The frequency of this oscillatory mode is higher than that seen in larger (and higher power) discharges, due to the decreased residence time of the propellant within the channel. Linear geometry Hall thrusters permit simpler magnetic circuit configurations and enable stacking of multiple thrusters to provide modular arrays.

17 Claims, 8 Drawing Sheets

OTHER PUBLICATIONS

Y. Raitses et al., "Experimental investigation of the effect of channel material on hall thruster characteristics," IEPC 97–056, 25$^{th}$ International Electric Propulsion Conference, Aug. 24–28, 1997, Cleveland, OH.

V. Khayms et al., "Design of a miniaturized hall thruster for microsatellites," AIAA–96–3291, 32$^{nd}$ Joint Propulsion Vonference, Jul. 1–3. 1996, Lake Buena Vista, FL. (copy of this article is not enclosed).

W. A. Hargus, Jr. et al.. "Development of a linear hall thruster," AIAA–98–3536, 34$^{th}$ Joint Propulsion Conference, Jul. 13–15, 1998, Cleveland, OH.

N. B. Meezan et al., "Optical and electrostatic characterization of oscillatory hall discharge behavior," AIAA–98–3502, 34$^{th}$ Joing Propulsion Conference, Jul. 13–15, 1998, Cleveland, OH.

W. A. Hargus, Jr. et al., "Transient behavior of a low–power laser hall thruster," AIAA–97–3050, 33$^{rd}$ Joint Propulsion Conference Jul. 6–9, 1997, Seattle, WA.

J. M. Fife et al., "Numerical study of low frequency discharge oscillations in all thrusters," AIAA–97–3052, 33$^{rd}$ Joint Propulsion Conference Jul. 6–9, 1997 Seattle, WA.

W. A. Hargus, Jr. et al., "Laser induced fluorescence measurements of a laboratory hall thrster," AIAA 98–3645, 34$^{th}$ Join Propulsion Conference Jul. 13–15, 1998, Cleveland, OH.

P. H. Dawson, "Secondary electron emission yields of some ceramics," J. Appl, Phys. 37, 3644, 1978.

J. P. Beouf et al., "Low frequency oscillations in a stationary plasma thruster," J. Appl. Phys. 84, 3541, 1999.

N. B. Meezan et al., "Optical emission study of anomalous electron transport in a laboratory hall thruster," AIAA 99–2284, 35$^{th}$ Joint Propulsion Conference, Jun. 20–23, 1999, Los Angeles, CA.

W. A. Hargus, Jr., "Development of a linear hall thruster," AIAA 1998, pp. 1–9.

D. P. Schmidt et al., "Operating characteristics of a linear hall thruster with an open electron drift," 35$^{th}$ AIAA/ASME/SAE/ASEE Joint Propulsion Conference Exhibit 20–24 Jun. 1999, Los Angeles, CA pp. 1–10.

D. P. Schmidt et al., "A low–power, linear–geometry hall plasma source with an open electron–drift" Plasma Sources Sci. Technol. 9 (2000) pp. 68–76.

* cited by examiner

LOW POWER, LINEAR GEOMETRY HALL PLASMA SOURCE WITH AN OPEN ELECTRON DRIFT

CROSS-REFERENCE TO RELATED APPLICATIONS

This application claims the benefit of copending U.S. Provisional Application No. 60/141,565, filed Jun. 29, 1999, entitled "Linear Hall Thruster," the specification of which is incorporated herein by reference in its entirety.

STATEMENT REGARDING FEDERALLY SPONSORED RESEARCH OR DEVELOPMENT

This invention was supported in part by Grant Number AFOSR F49620-98-1-0011 from the Air Force Office of Scientific Research. The Government has certain rights in the invention.

FIELD OF THE INVENTION

This invention relates generally to plasma sources. More particularly, it relates to linear geometry Hall plasma sources.

BACKGROUND ART

Hall discharge plasma accelerators have been considered for use in satellite propulsion since the early 1960's (see C. O. Brown and E. A. Pinsley, AIAA J. 3, 853, 1965, and G. S. Janes and R. S. Lowder, Phys. Fluids 9, 1115, 19966). In a Hall plasma source, a low-pressure discharge is sustained within a bounded dielectric channel in crossed electric and magnetic fields. Electrons emitted from a cathode external to the channel, or created by the ionization processes, drift along the channel towards the anode located at the channel base. The anode also serves as the source of neutral propellant particles (typically xenon atoms). A radial component to the magnetic field is designed to be a maximum near the channel exit, and in this region the electrons become highly magnetized, as the classical electron Hall parameter is much greater than unity.

FIG. 1A is a cross-sectional schematic representation of a conventional Hall discharge plasma source 10, having a coaxial geometry rotationally symmetric about an axis 104. FIG. 1B is an axial view of conventional Hall discharge plasma source 10 taken along axis 104 of FIG. 1A. Coaxial Hall discharge plasma source 10 has an annular channel 102, within which surrounding solenoids 106, 108 generate a radial magnetic field B. An electric field E is generated in an axial direction 122 within annular channel 102 between an anode 110 at the base 114 of annular channel 102 and a cathode 112 external to annular channel 102. In this coaxial configuration, electrons are constrained to move in the azimuthal direction (indicated by arrows 152) of a closed E×B drift, with cross-field drift providing the necessary electron current to sustain the discharge. As the electron Hall parameter (the product of the electron cyclotron frequency, $\omega_{ce}=eB/m_e$, and the mean time between electron collisions $\tau$, where e is the electron charge, me is the electron mass, and B is the radial magnetic field), is much greater than unity, the Hall current density (the product of the electron charge e, the local number of electrons per unit volume $n_e$, and the electron Hall drift velocity $V_{ed}=E/B$, where E is the axial electric field) can be many orders of magnitude greater than the axial current density (the Hall current density divided by the Hall parameter). According to classical electron transport theory, electrons can circle annular channel 102 in the Hall (azimuthal) direction 152 many times before being captured at anode 110. Anode 110 also serves as the source of neutral propellant particles 111 (typically xenon atoms). A coaxial geometry allows for a "closed" electron drift in the Hall direction, and uninterrupted Hall current. The region of electrons thus trapped acts as a volumetric zone of ionization 113 that in some devices may occupy only a small fraction of the overall channel depth D. Ions 120 are generated in the volumetric zone of ionization 113 by collisions of neutral propellant particles 111 with the trapped electrons. Ions 120, substantially unaffected by magnetic field B because of their large inertia, are accelerated by electric field E resulting from the impeded electron flow (the resistance to the flow of electrons as a result of the applied magnetic field), producing thrust. Accelerated ions 120 recombine with available electrons in the region external to channel 102 to provide a source of high thrust neutral particles 121. Very high ionization fractions and ion velocities can be generated with these discharges. Accordingly, due to their high efficiencies and high specific impulse (the resulting ion velocity divided by the gravity constant 9.8 $m/s^2$), coaxial Hall discharge plasma sources 10 in the 1–5 kW power range are being evaluated as plasma thrusters for use on commercial, military, and research spacecraft (see F. S. Gulczinski and R. A. Spores, "Analysis of Hall-Effect Thrusters and Ion Engines for Orbit Transfer Missions," AIAA-96-2973, 32$^{nd}$ Joint Propulsion Conference, Jul. 1–3, 1996, Lake Buena Vista, Fla.).

A precise theory is lacking for the mechanism of cross-field electron transport in Hall plasma thrusters. Early experiments on Hall plasma sources indicated that classical electron transport theory could not account for the measured "anomalous" axial (cross-field) electron current densities. Janes and Lowder (cited above) drew attention to the presence of density and electric field fluctuations within the channel of a Hall discharge, and first suggested that these plasma disturbances enhance the axial electron current. Indirect measurements of the "effective" Hall parameter as a result of these fluctuations were in agreement with the anomalous transport coefficient first identified by Bohm et al. (see D. Bohm, in The *Characteristics of Electrical Discharges in Macnetic Fields*, A. Guthrie and R. K. Wakerling, Eds., McGraw Hill, N.Y., 1949) which characterizes the process now widely recognized as "anomalous" Bohm diffusion (see F. F. Chen, *Plasma Physics and Controlled Fusion*, 2$^{nd}$ Edition, Plenum Press, NY, p. 193, 1985). The Bohm mechanism predicts an electron mobility that scales inversely with the magnetic field strength (as opposed to the classical $B^{-2}$ scaling), and an effective electron Hall parameter of about 16. At conditions typical of coaxial Hall plasma thrusters near the region where the magnetic field is strongest, the classical Hall parameter is about 500–1000. A value of 16 represents a significant enhancement in the cross-field drift, and indicates that the ratio of Hall current density to axial current density may be much less than that suggested by classical transport theory.

Whereas an enhanced electron current due to fluctuations is one possible mechanism for enhanced electron transport, the operation of modern Hall plasma thrusters seems to depend significantly on the properties of dielectric channel walls 116 (see Raitses et al., cited above). Previous researchers have proposed the possibility of an enhanced "near-wall conductivity" due to the "wall scattering" of electrons. Whereas it seems that precise knowledge of which mechanism is responsible for transport is necessary to properly scale a Hall discharge is lacking, it is shown below that either of these mechanisms exhibits the necessary dependency on discharge parameters to achieve a desired scaling in discharge size or power.

Modern coaxial Hall plasma thrusters 10 that operate in the 1–5 kW power range have been shown to operate with very high thrust efficiencies in the range of approximately 50%. These thrusters have annular acceleration channel diameters 2R ranging from 50 to 280 mm. One feature common to these thrusters is that channel width W is approximately 15% of channel diameter 2R, which itself is about twice the acceleration channel depth D. In scaling these discharges to operate at various power ranges, it is often desirable to preserve a geometrical relationship between channel width W, diameter 2R, and depth D, although the physical basis for the commonly used geometrical relationships is not well understood.

In a coaxial Hall thruster 10, the magnetic field B near a channel exit face 118 is sufficient to trap the electrons in an orbital cyclotron motion 130, in a plane orthogonal to magnetic field B. The electron orbit radius $r_e$ ("Larmor radius") is generally smaller than the electron mean free path $\lambda$ and the acceleration channel width W. In this way, the electrons are confined to the magnetized portion of the plasma discharge. The Larmor radius, being dependent on particle mass, is much larger for ions, which are substantially unaffected by the magnetic field. The electron Larmor radius, $r_e$, scales as:

$$r_e \sim \frac{T_e^{1/2}}{B}. \tag{1}$$

Here B is the magnetic field strength and $T_e$ is the electron temperature. In the design of a low power (and hence presumably smaller) discharge, a decrease in W requires a corresponding decrease in $r_e$. The magnetic field strength can be tailored for proper scaling; however, the electron temperature is not easily adjusted, as it is a consequence of a more complex relationship between geometry and operating conditions. The electron temperature is established through a balance between ohmic dissipation, electron-particle collisions (including ionization), and electron-wall collisions. Another approach is to scale the magnetic field strength as necessary and apply reasonable scaling arguments to preserve the mean electron energy from one design to another. It is seen from Eqn. (1) that, if the electron temperature is to be preserved in scaling to lower powers, reducing the characteristic size of the thruster requires a concomitant increase in the operating magnetic field strength.

In a Hall discharge's use as a propulsion device, it is desirable to efficiently utilize the propellant, by achieving as high an ionization fraction possible. In scaling a higher-power Hall discharge to lower powers, it is therefore desirable to preserve the ratio of the characteristic time to ionize the propellant to the residence time of the propellant in the discharge channel. The ionization time can be found from the inverse of the volumetric rate of ionization $R_i$, which scales linearly as the electron and neutral densities ($n_e$ and $n_a$):

$$R_i = n_e n_a \alpha_i(T_e). \tag{2}$$

Here, $(\alpha_i(T_e)$ is the temperature-dependent electron impact ionization rate coefficient. The characteristic time for ionization is $\tau_i = n_e/R_i$:

$$\tau_i = 1/n_a \alpha_i. \tag{3}$$

The residence time for a neutral atom can be found by dividing the acceleration channel depth D by the velocity of the neutrals, so it is expected to scale as:

$$\tau_R \sim D/T_a^{1/2}. \tag{4}$$

Here, $T_a$ is the neutral xenon temperature, which is typically assumed to be relatively uniform, and which largely controls the gasdynamic behavior of the neutral particles within the channel. The ratio of these two parameters, the ionization time over the residence time, scales as:

$$\frac{\tau_R}{\tau_i} \sim D n_a, \tag{5}$$

wherein it is assumed that the neutral xenon temperature (along with the electron temperature) is invariant to scale. This assumption regarding the invariance in $T_a$ may be tenuous, since the xenon temperature depends on the anode and channel wall temperatures, both of which are likely to be considerably higher for a low power device, because of the geometric scaling conclusions described below. A consequence of Eqn. (5) is that a geometric reduction in the channel depth requires a corresponding increase in the neutral particle density to preserve the ratio of time scales. As described below, this density increase is achieved by properly scaling the mass flow rate and the channel area.

The axial variation in the magnetic field also produces a significant impact on discharge performance. In a modern coaxial Hall thruster, the radial magnetic field is sharply peaked near the exit of the acceleration channel, with a distribution width that is much less then the channel depth. A high magnetic field near the anode can lead to a large anode fall loss as electrons experience resistance to current flow.

Since magnetic fields are difficult to shape, especially for coaxial designs, the depth of the channel is often dictated more by the magnetic field distribution than geometric scaling of the channel length.

Based on the physics reviewed above, the scaling of the discharge is relatively straightforward. The desired discharge voltage $\phi_d$ is treated as a design parameter, because it directly determines the ion velocity (and hence specific impulse of the thruster), often dictated, for example, by satellite mission objectives.

The assumption that the electron temperature can be preserved with proper scaling is justified, if it is established that for a reduction of the total power by some factor $\zeta$, the rates of energy loss and thrust power are correspondingly reduced by the same factor. The reduction in discharge power without a reduction in the discharge voltage implies a reduction in the overall discharge current. However, for proper geometric scaling, the area is correspondingly reduced by the factor $\zeta^2$, such that the current densities must be increased by the factor $1/\zeta$. The necessary scaling in the ion current density (and hence thrust power) is achieved if the plasma density is correspondingly increased, since the velocity is unchanged. The necessary scaling in the axial electron current density is achieved if the axial electron drift velocity, $V_{ed}$, is arguably scale-invariant. As described previously (see W. A. Hargus, Jr., et al., cited above) both the anomalous Bohm transport and wall collisions will give rise to drift velocities that are scale-invariant. The axial drift velocity associated with Bohm transport is determined by the ratio of the electric field strength E, to the magnetic field strength B:

$$V_{ed_{Bohm}} = \frac{e}{16B}E \sim \frac{E}{B} \tag{6}$$

which is preserved through a geometric scaling. If the cross-field transport is largely controlled by wall collisions, then, for highly magnetized electrons ($\omega_{ce}$=eB/$m_e$>>$V_{wall}$=$C_e$/W, the wall scattering frequency) (here, $C_e$ is the mean thermal electron speed, which is preserved if the temperature is preserved, and e and $m_e$ are the charge and mass of the electron, respectively), the axial electron drift velocity is approximately:

$$V_{ed_{Wall}} = \frac{eEv_{wall}}{m_e\omega_{ce}^2} \sim EW \tag{7}$$

which is also preserved with the proper geometric scaling, because the magnetic field scales as B~1/w, as described above. The increased electron number density (by the factor 1/ζ) is achieved because the corresponding decrease in the mass flow rate results in an increase in $n_a$, since the area is decreased by the factor $\zeta^2$. This relies on the assumption that the ionization fraction is preserved, which is reasonable if the ratio of time scales presented in Eqn. (5) is also preserved.

To preserve the electron temperature, the electron energy loss rates also scale in proportion to the decrease in power. The necessary scaling is obtained, if the dominant energy loss mechanism is through wall collisions. It is noteworthy that volumetric ionization also satisfies the scaling condition, because the energy loss rate through ionization is:

$$E_i = n_e n_a \alpha_i V_c \epsilon_i \sim \zeta \tag{8}$$

Here, $V_c$ is the channel volume and $\epsilon_i$, the ionization energy of xenon. One undesirable consequence of the geometric scaling for operation at reduced power levels is an increase in heat flux to the channel walls (see V. Khayms and M. Martinez-Sanchez, "Design of a Miniaturized Hall Thruster for Microsatellites," AIAA-96-3291, 32$^{nd}$ Joint Propulsion Conference, Jul. 1–3, 1996, Lake Buena Vista, Fla.). Because the power is reduced by the scaling factor ζ and the wall area reduced by $\zeta^2$, the heat flux to the walls increases by a factor of 1/ζ. This scaling consequence is potentially problematic for very low power (and consequently reduced size) Hall plasma thrusters.

It is noteworthy that the decreased residence time of the neutral xenon in the channel (see Eqn. (4)) should result in a shift to high frequencies in the characteristic breathing instability often seen in the 7–10 kHz frequency range in higher power devices (see J. M. Fife, M. Martinez-Sanchez, and J. J. Szabo, "Numerical Study of Low Frequency Discharge Oscillations in Hall Thrusters," AIAA-97-3052, 33$^{rd}$ Joint Propulsion Conference Jul. 6–9, 1997 Seattle, Wash.). Current oscillation frequencies in the discharge are consistent with the nearly 1/10$^{th}$ scaling described in the above analysis.

In summary, it is desirable to provide a method to scale the power of a Hall thruster by some arbitrary factor ζ, such that the characteristic scale lengths of the thruster and mass flow rates are scaled by the same factor, ζ. The appropriate adjustment to the magnetic field (preserving its shape) is to increase it by the factor 1/ζ. With these scaling laws, according to the analysis described above, the electron temperature should be preserved, as well as the ratio of electron current to ion current.

Accordingly, it is desired to design Hall thrusters that are smaller, more compact, and more efficient at low power than present coaxial Hall thrusters. It is further desired to design such Hall thrusters with larger specific thrust area ratios and simpler magnetic circuit configurations than those of present coaxial Hall thrusters. It is moreover desired to design such Hall thrusters, which can be combined in a modular array to extend the operating envelope of a propulsion system. Finally, it is desired that such Hall thrusters perform more ruggedly and reliably than present coaxial Hall thrusters.

OBJECTS AND ADVANTAGES

Accordingly, it is a primary object of the present invention to provide a method to design Hall thrusters that are smaller, more compact, and more efficient at low power than present coaxial Hall thrusters. It is a further object to design such Hall thrusters with larger specific thrust area ratios and simpler magnetic circuit configurations than those of present coaxial Hall thrusters. It is moreover an object to design such Hall thrusters, which can be combined in a modular array to extend the operating envelope of a propulsion system. Finally, it is an object for such Hall thrusters to perform more ruggedly and reliably than present coaxial Hall thrusters.

SUMMARY

These objects and advantages are attained by a Hall plasma thruster design having an electric field oriented parallel to a first axis and a magnetic field oriented substantially orthogonal to the electric field. The Hall thruster design has a substantially linear channel having a length mutually orthogonal to the electric and magnetic fields, an open exit face extending substantially the entire length of the channel, and channel walls extending perpendicular to the open exit face. The channel has a base substantially parallel to the exit face, which is separated from the open exit face by a channel depth. The Hall thruster additionally has a source of electrons external and adjacent to the channel exit face, providing electrons that undergo open electron drift within the channel in a direction substantially parallel to the channel length, under combined influence of the orthogonal electric and magnetic fields. A source of neutral particles, typically xenon atoms, is positioned adjacent the base of the discharge channel. The neutral particles enter the channel and undergo collisions with the electrons, resulting in the ionization of a portion of the neutral particles.

The walls of the channel are constructed of electrically insulating material, preferably a ceramic such as alumina or boron nitride. The electric and magnetic field values, as well as aspect ratios between channel length and channel depth are selected in accordance with a scaling methodology.

In operation, a plasma thruster in accordance with an embodiment of the present invention is placed in a vacuum environment having a background pressure preferably not greater than approximately $10^{-4}$ Torr. The ionized particles are accelerated by the electric field and are ejected from the discharge channel through the open exit face. A portion of the ejected ions combine with electrons to form neutral particles, which serve as a neutral propellant.

Linear Hall thrusters simplify magnetic circuit configurations, permitting the use of permanent magnets. Linear thrusters further enable efficient stacking of thrusters to provide modular arrays. This modular approach can be used to maintain operation at maximum efficiencies by selectively turning individual linear thrusters on and off to change the thrust level, rather than changing the operating point of a single thruster.

The present invention is better understood upon consideration of the detailed description below, in conjunction with the accompanying drawings.

BRIEF DESCRIPTION OF THE FIGURES

The present invention may be better understood, and its numerous objects, features, and advantages made apparent to those skilled in the art by referencing the accompanying drawings. For simplicity and ease of understanding, the use of similar reference symbols in different drawings indicates similar or identical elements.

DETAILED DESCRIPTION

Figure 1A:
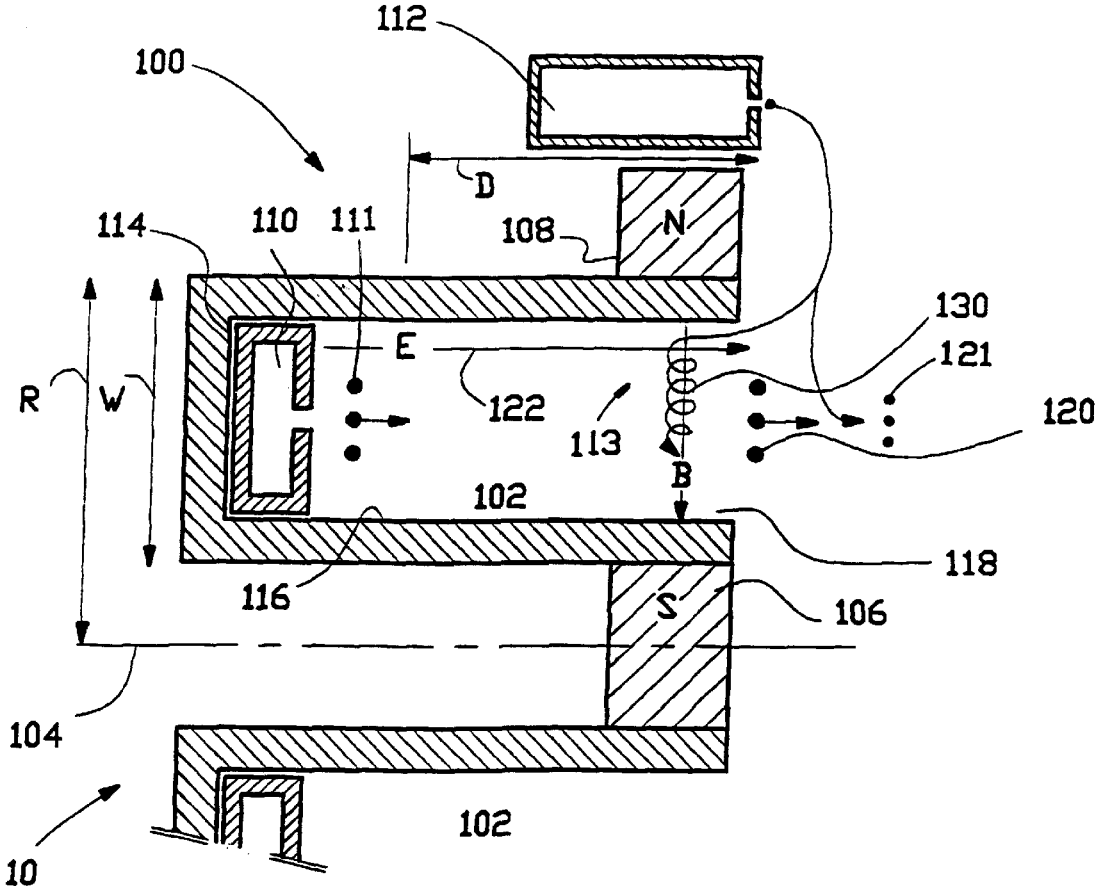
(PRIOR ART) FIG. 1A
FIG. 1A is a cross-sectional schematic representation of a conventional Hall discharge plasma source, having a coaxial geometry rotationally symmetric about an axis.
Figure 1B:
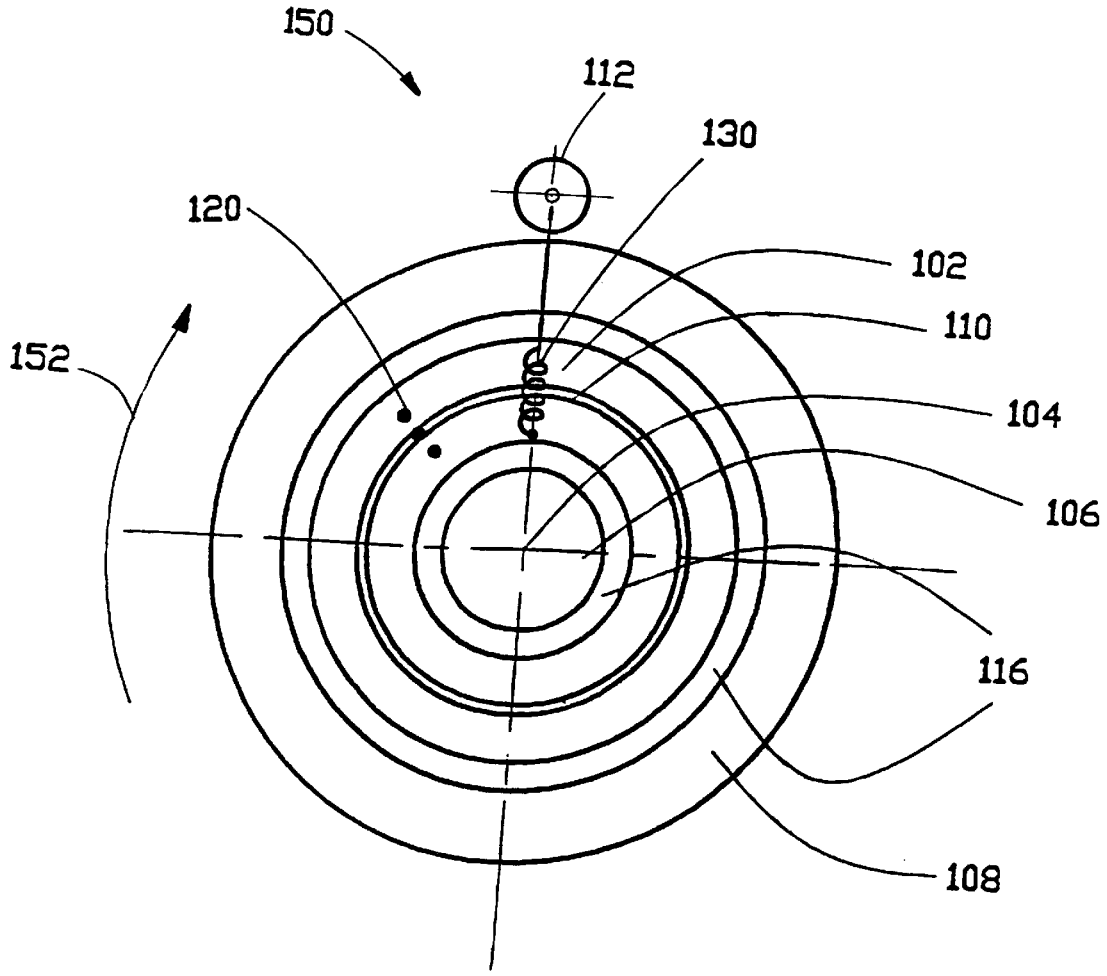
(PRIOR ART) FIG. 1B
FIG. 1B is an axial schematic view of the conventional Hall discharge plasma source of FIG. 1A.

Although the following detailed description contains many specifics for purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

Despite the progress that has been made in the development of coaxial Hall plasma thrusters that operate in the kilowatt power range, a need has developed for low thrust, high efficiency propulsion devices to be used for precise orbit control on small, power-limited satellites. A low power (10–100 W) Hall thruster could fill this need. The proper scaling of a Hall plasma thruster for efficient operation at such low powers requires a renewed examination of the discharge physics that controls thruster performance. Also, alternative geometries that can potentially reduce thruster mass and/or size should be investigated.

The scaling of coaxial Hall thrusters to lower powers has been discussed previously in the literature (see V. Khayms et al., cited above, and W. A. Hargus, Jr.; also M. A. Cappelli, "Development of a Linear Hall Thruster," AIAA 98-3336, $34^{th}$ Joint Propulsion Conference Jul. 13–15, 1998, Cleveland, Ohio). To our knowledge, however, no one has reported on the operation of a Hall plasma source with a linear geometry and hence an open electron drift. The merits of a linear geometry thruster are appealing, although any discharge model based on either classical or "Bohm" electron transport indicates that even for moderate aspect ratios (depth to channel length ratio, D/L), such a geometry would interrupt the electron Hall current. A linear geometry allows compact packaging of the thruster in a limited space, making the magnetic circuit amenable to the use of permanent magnets. Also, a multiple array of linear Hall thrusters can be efficiently stacked to extend the operating envelope of the propulsion system. In an embodiment of this configuration, the lengths of the channels are parallel to one another, and the polarities of the magnetic fields are reversed between adjacent channels. This modular approach can maintain operation at maximum efficiencies by simply turning stacked low-power linear thrusters on and off as needed to change the thrust level, rather than change the operating point of a single thruster.

Below are described the design and operation of a low-power linear geometry Hall plasma thruster based on scaling principles described above (see W. A. Hargus, Jr., and M. A. Cappelli, cited above). A linear thruster is scaled to operate at a power level that is 10–15% that of coaxial discharges reported in previous years (see N. B. Meezan, W. A. Hargus, Jr., and M. A. Cappelli, "Optical and Electrostatic Characterization of Oscillatory Hall Discharge Behavior," AIAA-98-3502, $34^{th}$ Joint Propulsion Conference, Jul. 13–15, 1998, Cleveland, Ohio, and W. A. Hargus, Jr., N. B. Meezan, and M. A. Cappelli, "Transient Behavior of a Low-Power Laser Hall Thruster," AIAA-97-3050, $33^{rd}$ Joint Propulsion Conference Jul. 6–9, 1997,Seattle, Wash.). This linear geometry, non-coaxial Hall plasma thruster has been fabricated and operated at near-design conditions. Operating characteristics are presented for both alumina and boron nitride acceleration channels for a range of peak magnetic field strengths.

In a weakly-collisional steady-state plasma, where the electron Hall parameter (previously defined) satisfies the condition:

$$\omega_{ce}\tau_e >> 1, \tag{9}$$

the ratio of the cross-field (axial) electron current to the Hall current is:

$$\frac{J_{ez}}{J_{eH}} = \frac{1}{\omega_{ce}\tau_e}. \tag{10}$$

Here, factor $\tau_e$ is the time between electron collisions. Using the classical electron collision time from Eqn. (9), for most modern thrusters the resulting Hall parameter is typically in the range of 100–1000. Note that the current ratio described in Eqn. (10) is a scale invariant in that the scaling laws introduced here would increase the electron cyclotron frequency in proportion to the decrease in the electron collision time. It is precisely this vast inequality between the axial and Hall current that prompted the use of a coaxial design in early thrusters since, as mentioned above, a coaxial geometry with a closed electron drift allows the electrons to traverse the annulus many times prior to anode capture.

The presence of an anomalous electron transport mechanism, whether fluctuation or possibly wall-scattering induced, reduces the demand placed on the ratio of the Hall to axial electron current. A value of 16 for the "effective" Hall parameter, as suggested by the anomalous Bohm mobility, still implies an electron drift direction that is predominantly in the direction of the crossed electric and magnetic field. However, the value of 16 for the Bohm coefficient is strictly speculative, as the effective Hall parameters in modern Hall thrusters have not been accurately characterized, and coefficients within a factor of two or three of this value have been obtained for other plasma devices (see F. F. Chen, cited above).

It is therefore conceivable that the Bohm coefficient can be less than this value. If so, then the necessity for a closed electron-drift is removed, and with an adequate aspect ratio (ratio of channel length to channel depth), a linear Hall thruster with an open electron drift may perform equally well in comparison to closed-drift designs. However, even with an effective Hall parameter of unity, the linear design does impose an asymmetry in the electron flow, giving rise to expected asymmetric current densities within the channel that may impact discharge performance.

A linear thruster geometry is simpler to construct and optimize for magnetic field distribution, possibly with permanent magnets, and can be designed to be very compact. A multiple array of linear thrusters can be efficiently stacked in order to extend the operating envelope of the propulsion system. An advantage of a linear geometry over a coaxial one is the ease at which a desired magnetic field distribution can be achieved with a less complicated magnetic circuit.

The design of the linear Hall thruster described here is based in part on the scaling of a coaxial reference thruster recently operated at a nominal power of 400–700 W (see W. A. Hargus, Jr. and M. A. Cappelli, "Laser Induced Fluorescence Measurements on a Laboratory Hall Thruster," AIAA 98-3645, 34$^{th}$ Joint Propulsion Conference Jul. 13–15, 1998, Cleveland, Ohio). A scaling factor of $\zeta$=0.1 was used in accordance with the scaling laws described above, although the performance of the magnetic circuit precluded the use of a channel depth that was one-tenth the depth of the reference coaxial discharge. The channel depth deviated from strict scaling laws in order to reduce the magnetic field strength at the anode, and hence the anode fall losses. A comparison of the coaxial thruster used for scaling and the linear thruster is shown in Table 1.

Figure 2A:
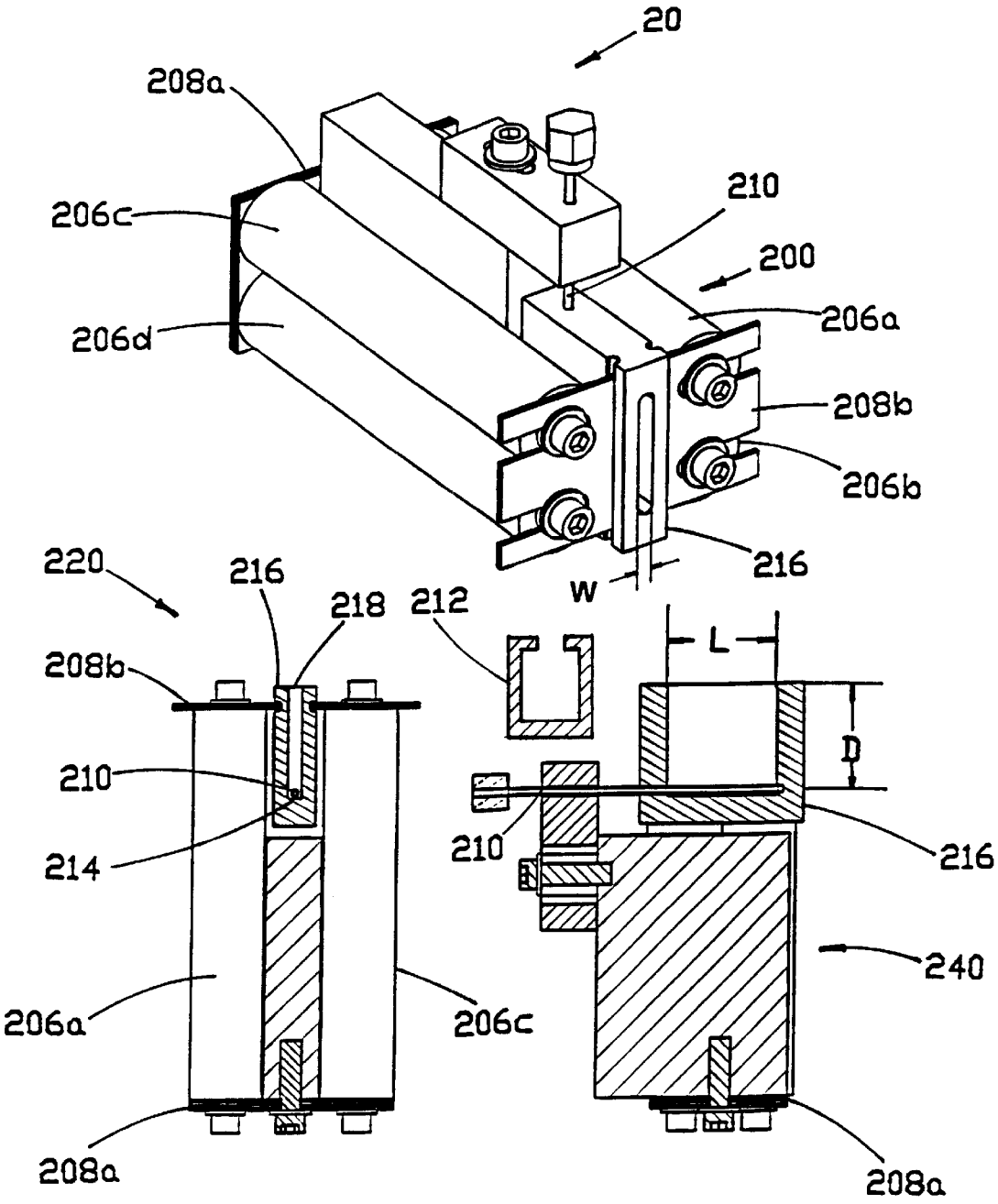
FIG. 2A is a schematic diagram of a linear Hall thruster including an isometric view, a top cross-sectional view, and a side cross-sectional view, in accordance with an embodiment of the invention.

FIG. 2A is a schematic diagram of a linear Hall thruster 20 including an isometric view 200, a top cross-sectional view 220, and a side cross-sectional view 240, in accordance with an embodiment of the invention. A magnetic circuit includes four 90-mm long electromagnet windings 206*a*–206*d* consisting of a 9.5 mm diameter core of commercially pure iron with 6 layers of 22 gauge insulated copper magnet wire. A magnetic bottom plate 208*a* is 3-mm thick silicon steel, whereas a magnetic top plate 208*b* is 1.5-mm thick silicon steel. A discharge channel 216 is fabricated in two versions, one constructed with walls of high purity alumina ceramic and the other with walls of boron nitride. Discharge channel 216 has a width W, a length L, and a depth D between a channel exit face 218 and a channel base 214. The magnetic circuit including electromagnet windings 206*a*–206*d* is configured to produce a magnetic field B substantially parallel to width W of discharge channel 216. In some embodiments, magnetic field B is produced by permanent magnets. An anode 210, for example a 1.6-mm diameter stainless steel tube with 14 propellant holes, 0.2 mm in diameter spaced by 1.6-mm, is positioned in discharge channel 216 adjacent channel base 214. E Anode 210 is a source of neutral particles, typically xenon atoms, which enter discharge channel 216.

A cathode 212 (shown in side cross-sectional view 240 only), external and proximate to discharge channel 216 and used to supply electrons to neutralize the ion beam and support the necessary electric field, is a commercial Ion Tech. Inc. HCN-252 hollow cathode. It is capable of supplying a maximum current of 5 A at xenon flow rates of 0.1 to 0.5 mg/s. It is mounted externally in front of the thruster, such that the hollow cathode exit is approximately 1 cm above the exit of the channel. The cathode is identical with that used in higher power thrusters, and the flow rate used here is comparable to the flow rate through the thruster itself (2 sccm). An electric field E is established between the cathode and anode 210, substantially orthogonal with magnetic field B. The near exit-face xenon density due to the cathode flow potentially has a negative effect on the discharge performance. However, because the neutral gas density in this low power discharge is about a factor of 5–10 times that in a higher power prototype, the effect is expected to be no greater here than in the higher power version. No attempt at designing and fabricating an optimally scaled cathode has been made, although other embodiments of low-power (<50 W) Hall thrusters can incorporate such a structure.

Anode 210 is powered, for example, by a Sorensen SCR600-1.7 laboratory power supply capable of providing 600 volts and 1.7 amps. Anode 210 also has a 4Ω resistor in the power line to serve as ballast during discharge initiation. A cathode heating element is powered by a low voltage direct-current (DC) power supply capable of providing the 8.5 A required to heat the cathode for startup and 4.0 A after start. The cathode flow rate of xenon is 2 sccm, a typical value used during operation of higher power coaxial discharges. A cathode keeper uses a Sorensen SCR300-6 laboratory power supply, providing 250 V for initial cathode start and approximately 10 V and 250 mA during thruster operation. The power required for the magnetic circuit solenoids is provided by a Tektronix PS281 DC power supply operating in current limited mode.

In operation, as described above, electrons from the cathode become trapped in the orthogonal E and B fields in the discharge channel 216,where they collide with and ionize the neutral particles from anode 210. The resulting ions are accelerated and ejected out of the channel exit face 218 by the E field, thereby providing thrust. External to discharge channel 216, the ejected ions recombine with available electrons to provide a high-thrust neutral propellant.

Figure 2B:
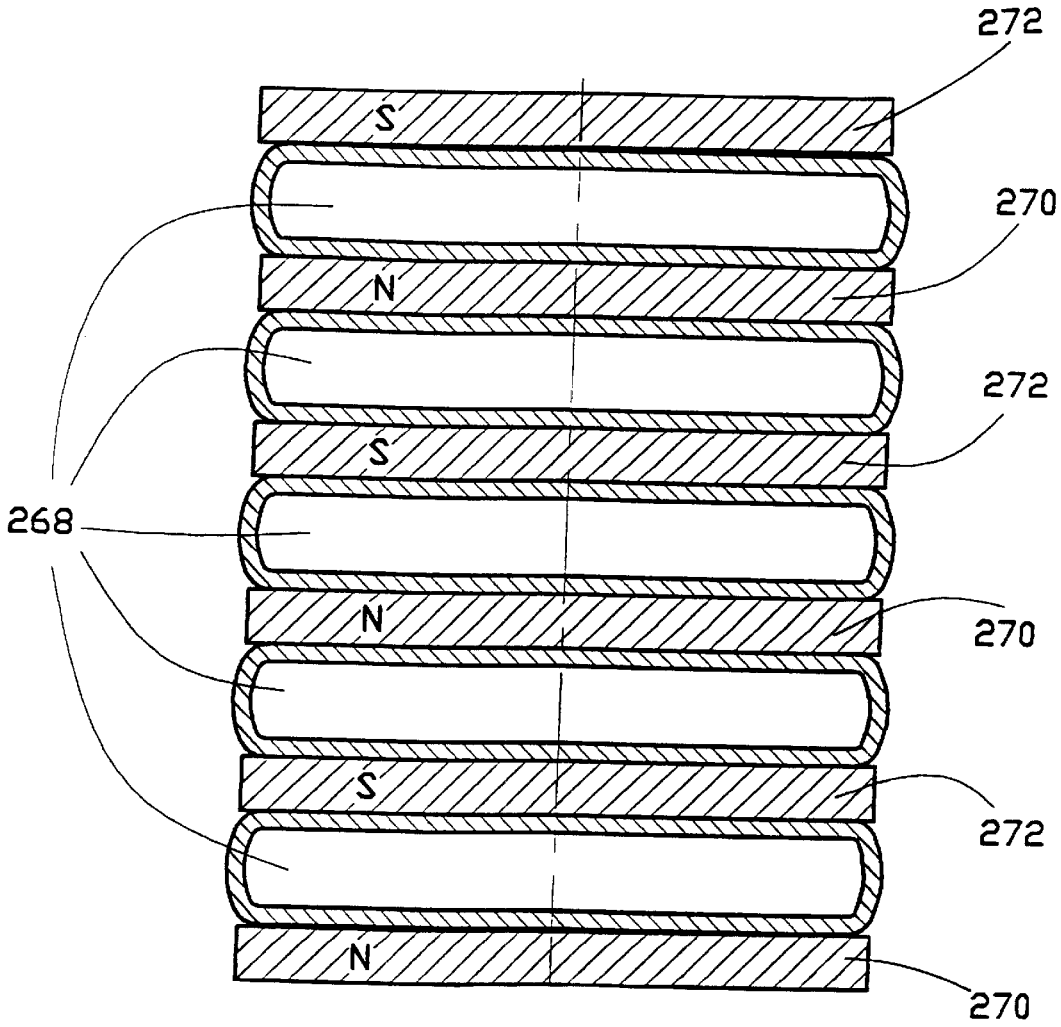
FIG. 2B is a schematic axial view illustrating a configuration for stacking of linear Hall thrusters to form a modular array, according to an embodiment of the invention.

FIG. 2B is a schematic axial view illustrating a configuration of stacked linear Hall thrusters to form a modular array 260, according to an embodiment of the invention. In this example, linear channel exit faces 268 are arranged parallel to one another. Between consecutive pairs of channel exit faces 268 are magnets 270, 272 having alternating (N, S) polarity.

EXAMPLE

A high vacuum test facility includes a non-magnetic stainless steel tank approximately 1 m in diameter and 1.5 m in length. The facility is pumped by two 50 cm diffusion pumps, backed by a 425 l/s mechanical pump. The base pressure of the facility is approximately $10^{-6}$ Torr as measured by an ionization gauge uncorrected for mass species. Thruster testing at xenon flow rates of 2–5 sccm results in chamber background pressures in the region of $4\times10^{-5}$ Torr. This indicates that the facility has a xenon gas pumping speed of around 2000 l/s. Propellant flow to the thruster anode and cathode is controlled by two Unit Instruments 1200 series mass flow controllers factory calibrated for xenon. The propellant used in this test was research grade (99.99%) xenon.

Figure 3:
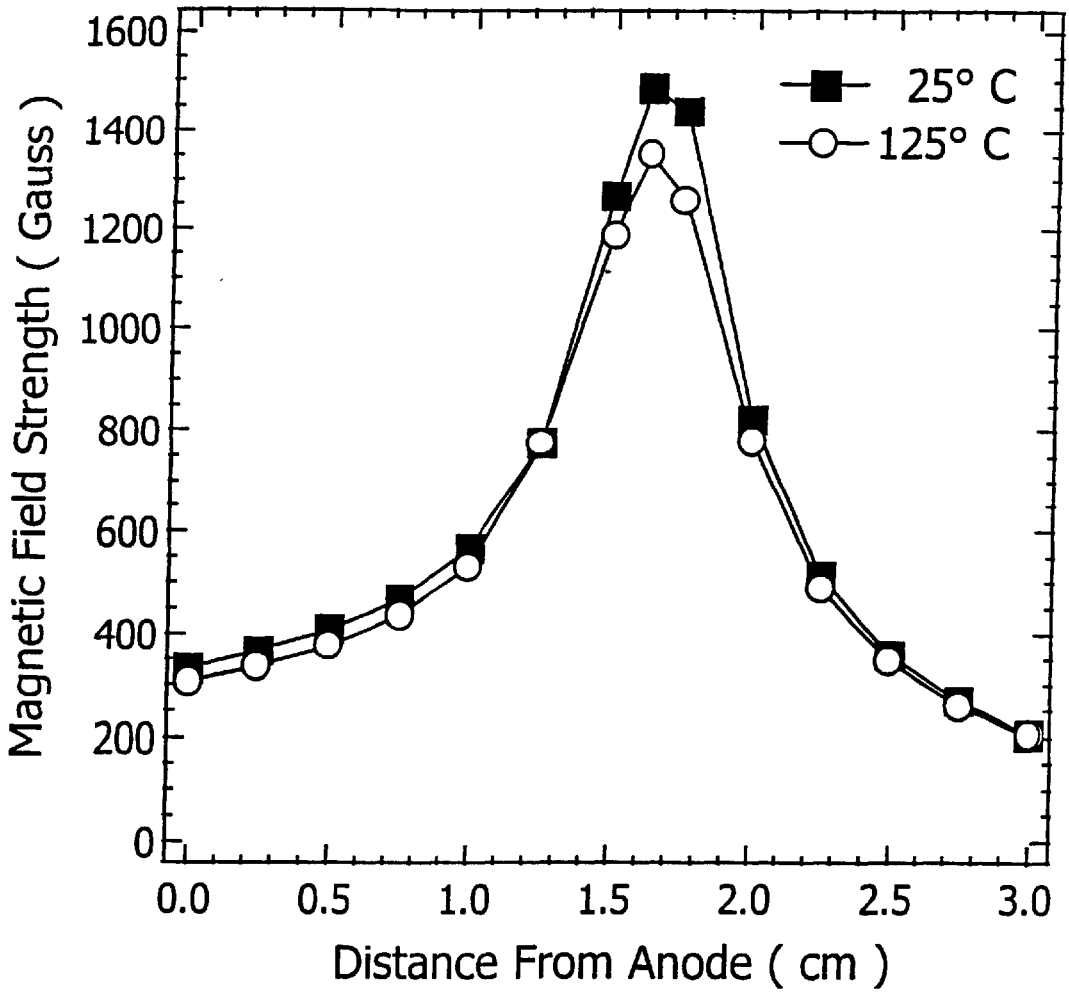
FIG. 3 is a graphic representation of the measured field distribution for a winding current of 1.25 amps for two different temperatures.

Measurements of the transverse component of the magnetic field show that the magnetic field near the anode is 23% of the peak value, which is located about 2 mm upstream of the channel exit. FIG. 3 is a graphic representation of the measured field distribution for a winding current of 1.25 amps for two different temperatures. These measurements were obtained ex-situ, by heating the entire thruster unit in an oven at ambient conditions while measuring the magnetic field strength. It can be seen that the peak value of 1500 gauss at room temperature drops to less than 1400 gauss with a 100° C. temperature rise. This is significant in that the temperature of the acceleration channel fabricated from boron nitride has been measured by embedded thermocouples to be as high as 440° C. during operation in the thruster.

The voltage and current of the thruster was recorded by acquiring data through a National Instruments PCI-5102 data acquisition card plugged into a desktop computer. A voltage divider was used, whereby the 5V maximum voltage limit to the card was not exceeded while testing the thruster up to 250 volts. The current was monitored by measuring the voltage drop across the 4Ω ballast resistor.

The thruster described was run at near-design conditions. To start the thruster, a glow discharge was initiated with the magnetic field turned off. With the power supply under current limit control and an upper limit set on the voltage, the magnetic field was increased. The voltage gradually increased until it reached the voltage limit setting. The power supply subsequently switched into voltage control, where most of the data reported was taken.

During operation at magnetic fields above 600 gauss, it was noted that the discharge was slightly asymmetric, being more intense near the side of the channel in direction of the E×B electron drift. It was especially apparent during operation of the alumina thruster that this end wall became extremely hot and glowed intensely. This glow was contrasted to the bulk of the thruster channel, which did not show this intense heating. On one occasion, after a few minutes of running the alumina thruster, the acceleration channel cracked along the edge of the glowing area. This failure was likely due to a high thermal stress caused by extreme temperature gradients in this region of the channel wall. Operation with the boron nitride thruster did not result in such a non-uniform temperature field on the insulating wall. This difference between the boron nitride and alumina insulators is attributed to the difference in the thermal conductivity values of the materials. The boron nitride channel end wall in the direction of the electron drift was instrumented with four embedded J-type thermocouples distributed along its length. During nominal operation at 1500 gauss and 0.7 A, the thermocouples registered temperatures in excess of 400° C across the entire channel, with the side wall at around 440° C.

Figure 4A:
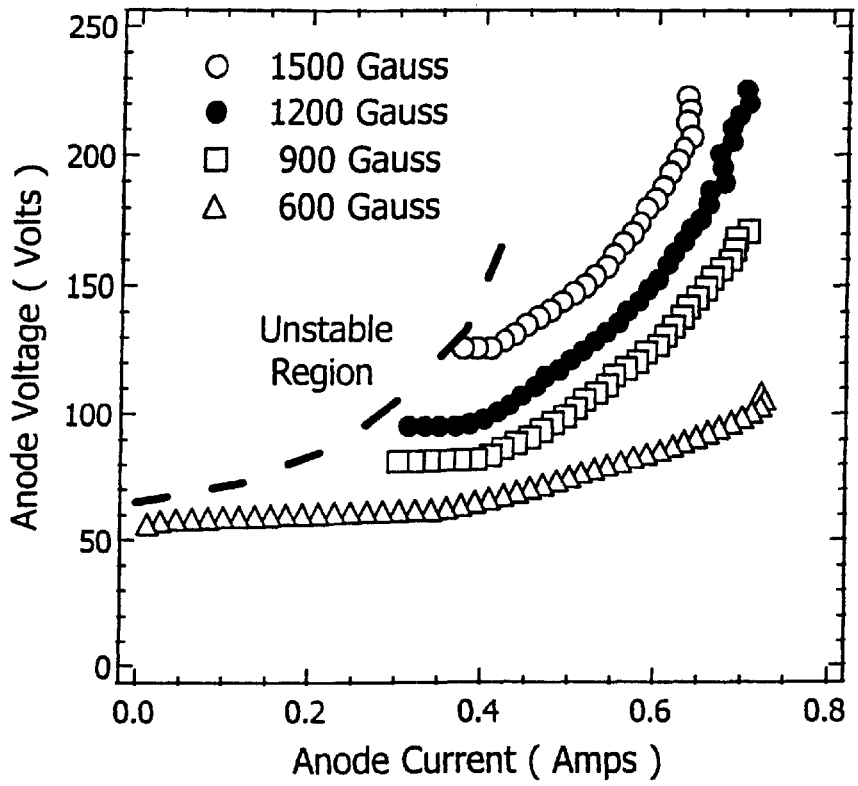
FIGS. 4A–4B are graphic representations of voltage (V)—current (I) characteristics recorded for both a boron nitride (FIG. 4A) and an alumina (4B) thruster channel for a range of magnetic field strengths and at a xenon flow rate of 2 sccm.
Figure 4B:
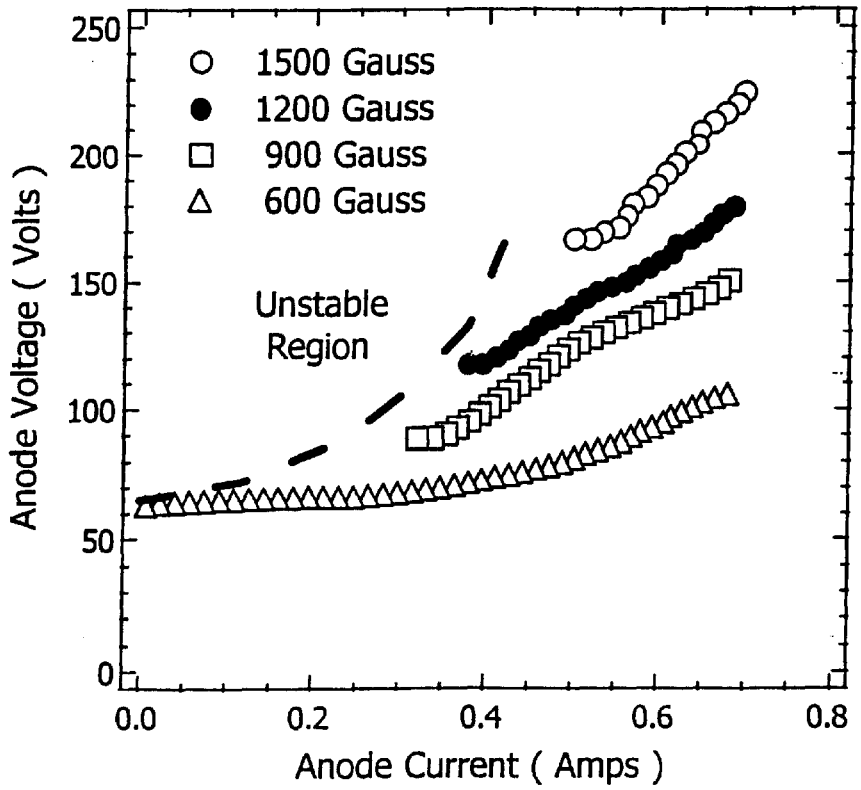

FIGS. 4A–4B are graphic representations of voltage (V)—current (I) characteristic's recorded for both the boron nitride (FIG. 4A) and alumina (4B) thruster channel for a range of magnetic field strengths and at a xenon flow rate of 2 sccm. The V-I characteristics for the boron nitride channel are somewhat typical of Hall discharges, with an "ionization branch" at low currents and low magnetic field strengths, and a relatively steep "current saturation branch" at high operating magnetic field strengths and high discharge current. However, these features are less distinct in the case of the alumina channel. In fact, the V-I characteristics do not show an obvious current saturation regime in this latter case. At relatively low magnetic field strengths, the V-I characteristics of the thruster with the alumina channel wall are nearly indistinguishable from that of the same thruster with a boron nitride wall. This is also the case for all magnetic field strengths investigated, at currents below about 0.5 A. Above these current levels, the V-I characteristics for the alumina channel thruster flatten out (note the apparent "knee" in the figure), whereas the boron nitride channel thruster voltage rises sharply.

The possible influence of secondary electron emission in establishing the electron transport in Hall thrusters has been discussed in the prior literature (see Y. Raitses, J. Ashkenazy, G. Appelbaum, and M. Guelman, "Experimental Investigation of the Effect of Channel Material on Hall Thruster Characteristics," IEPC 97-056, 25$^{th}$ International Electric Propulsion Conference, Aug. 24–28, 1997, Cleveland, Ohio; also J. M. Fife, et al., cited above). Alumina has a higher secondary electron emission coefficient than boron nitride (see P. H. Dawson, J. Appl. Phys. 37, 3644, 1978) and, in addition, secondary electron emission is sensitive to wall temperature. It is apparent that during thruster operation with the alumina walls, the wall temperature could have been sufficiently high to significantly enhance secondary electron emission. The higher secondary electron emission for the case of the alumina insulator wall would aid electron transport across the magnetic field. As a result, the thruster could not support as high a voltage as that supported by the thruster with the boron nitride wall. This conjecture would imply that there is a high electron flux (current) along the side wall opposite the direction of the electron Hall current, an argument that is consistent with the observation that the side wall of the boron nitride thruster is found to experience significant erosion. In a recent study by Raitses et al., cited above, there were significant differences in the V-I characteristics of a thruster operating with a machinable glass channel and a boron nitride channel. In that study, enhanced axial transport in the thruster with the machinable glass channel was attributed to wall effects, decreasing the thruster efficiency at high operating voltages. The qualitative findings reported on in this study agree with these past observations. It is also noteworthy that the conjecture that there is an enhanced electron current due to wall collisions is supported by the relatively poor efficiency of this discharge, as an upper limit of the ratio of the ion current to electron current is no more than 30%, based on full utilization (ionization) of the propellant.

In all examples, the thrusters exhibited a region of unstable operation. At all magnetic field strengths except the lowest value shown, the discharge had a low current limit in its operating envelope. Attempts to operate or start the discharge in this region would fail. This region of instability is closely tied to the requirement for enhanced electron transport, such that at low currents and high magnetic fields, the anomalous transport process cannot provide the necessary current to maintain the discharge.

The fact that the thruster ran without a mechanism for closing the Hall current electron drift confirms the importance of an electron transport process that is due to plasma fluctuations and/or wall effects associated with secondary electron emission. As in the higher power coaxial discharges, the linear discharge analyzed here also exhibited plasma fluctuations, which were detected as fluctuations in the external circuit discharge current.

Figure 5:
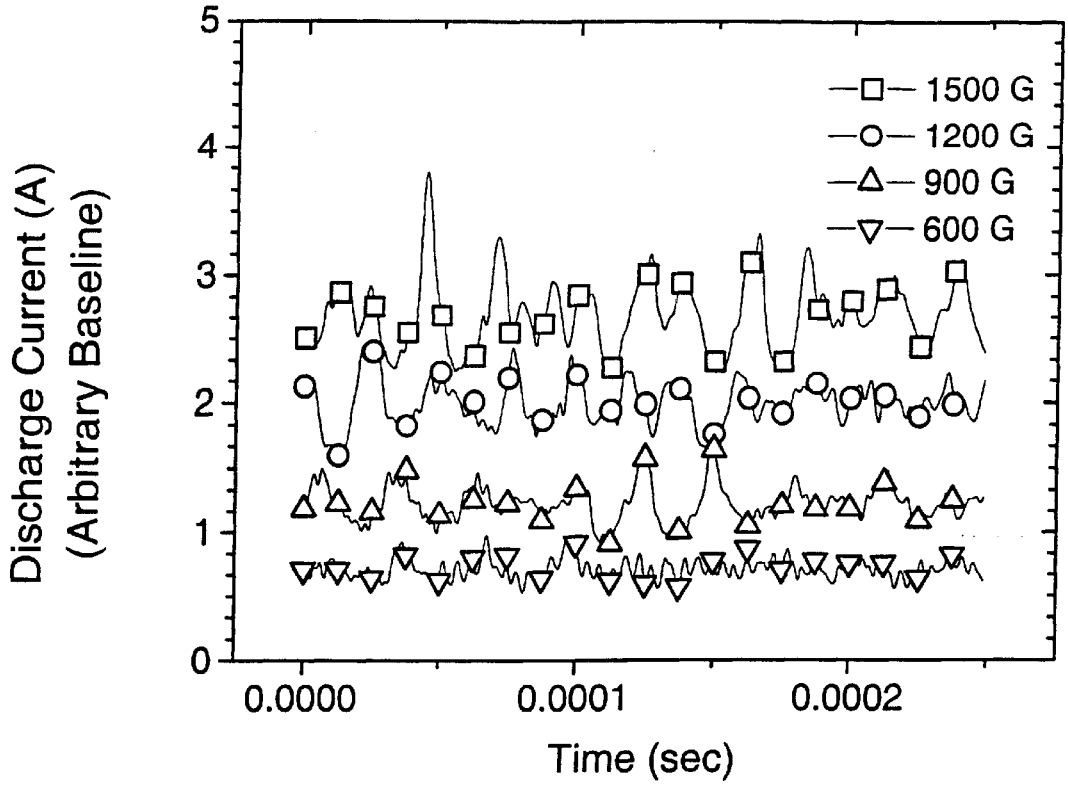
FIG. 5 is a graphic representation of the oscillations in the discharge current of a linear thruster operating with an alumina channel wall for a range of peak magnetic field strengths and at an average discharge current of 0.7 A.

FIG. 5 is a graphic representation of the oscillations in the discharge current of the linear thruster operating with the alumina channel wall for a range of peak magnetic field strengths and at an average discharge current of 0.7 A. The fluctuations in the discharge current for the boron nitride wall were qualitatively similar. It is apparent that at low magnetic fields, there is a relatively low frequency oscillation, on which higher frequencies are superimposed.

The low frequency oscillation increases in amplitude and in frequency as the magnetic field is increased. These intense low frequencies observed in this linear device are similar to those seen in coaxial devices, and are believed to be the so-called "breathing" mode of oscillation associated with the neutral xenon transit through the ionization zone (see J. P. Beouf and L. Garrigues, J. Appl. Phys. 84, 3541, 1999). This instability is associated with the disturbance in the balance established between the depletion of neutrals in the channel as a result of ionization, and their replenishment. Since the length of the ionization zone in this low-power Hall discharge is scaled to be some 5–10 times shorter than that of the reference thruster, the frequencies of these disturbances are expected to be at least a factor of five higher than those seen in the higher power coaxial devices.

Figure 6:
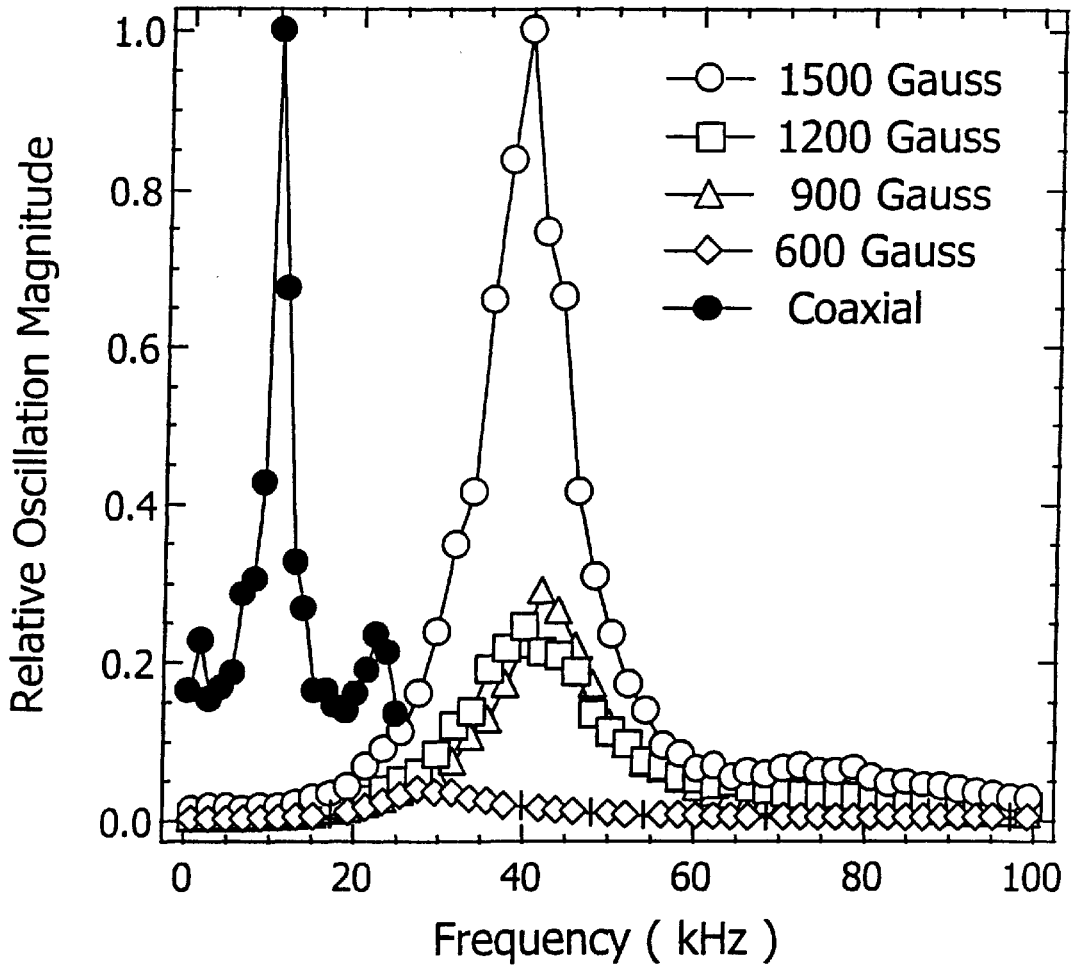
FIG. 6 is a graphic representation comparing the Fourier analysis of temporal fluctuations in discharge current of a reference 400 W (200 V, 20 sccm, 160 G, 2 A) coaxial thruster and a low-power linear thruster operating with a alumina channel wall, in accordance with data shown in FIG. 5.

FIG. 6 is a graphic representation comparing the Fourier analysis of temporal fluctuations in discharge current of a reference 400 W (200 V, 20 sccm, 160 G, 2 A) coaxial thruster and a low-power linear thruster operating with a alumina channel wall (data shown in FIG. 5). It is apparent that the low power thruster has a strong low-frequency mode, similar to that seen in the coaxial high power devices, at frequencies that are approximately four times higher than that of the higher power thruster. As the magnetic field is increased, the frequency of the fluctuations in the anode current also increase, until a magnetic field strength of 900 gauss, beyond which it remains constant. This result is seemingly inconsistent with the theoretical predictions of Boeuf and Garrigues (cited above) However, a direct comparison to the results in Boeuf and Garrigues is difficult to make, since in the example described above, the current is held constant while the magnetic field is increased (resulting in increased discharge voltages). In the calculations of Boeuf and Garrigues, the voltage is varied at constant magnetic field (giving rise to varying current) and/or the magnetic field is varied at constant voltage. As discussed in Boeuf and Garrigues, the frequency of this mode is seen to increase dramatically with voltage (at constant magnetic field). The response according to the example above is therefore likely to be a result of the response in the frequency to changes in both the voltage and the magnetic field.

It is interesting to note that at the highest magnetic field studied, there is a superimposed high frequency oscillation at about 80 kHz. Through particle simulations, Boeuf and Garrigues (cited above) also discovered the presence of strong disturbances in the plasma density and electric field upstream near the anode when the magnetic field continues to persist near the anode. The weak intensities seen here at the highest magnetic field studied may be a consequence of these near-anode instabilities, although a precise characterization of these instabilities in a linear geometry must still be performed.

An analysis and arguments for the scaling of a Hall plasma thruster to low powers are described. A linear geometry version of a thruster operating in the 50–100 W power range has been designed, fabricated, and operated at near design conditions. Preliminary results obtained so far indicate that at the scaled power levels, these low power plasma discharges operate at much higher channel wall temperatures.

The linear Hall plasma thruster described herein is found to have the characteristic discharge instabilities seen in higher power coaxial versions. Indirect evidence indicates that a linear device with open electron drift behaves in many ways similarly to a coaxial design with a closed electron drift. Since the linear discharge operates without a closed-Hall current, it suggests that there must be an anomalous mechanism for cross-field electron transport.

The experimental device might prove useful for investigating various materials for use as acceleration channels in Hall thrusters. The linear geometry allows easy fabrication from a variety of materials. A study of the operating characteristics of thrusters constructed with insulating walls fabricated from a wide variety of materials could be useful for understanding the effect of secondary electron emission on electron transport.

It will be clear to one skilled in the art that the above embodiments may be altered in many ways without departing from the scope of the invention. Accordingly, the scope of the invention should be determined by the following claims and their legal equivalents.

What is claimed is:

1. A plasma thruster, comprising:

an electric field oriented parallel to a first axis;

a magnetic field oriented substantially orthogonal to the electric field;

a substantially linear channel having:

a length mutually orthogonal to said electric and magnetic fields;

an open exit face extending substantially said length of said channel;

walls extending perpendicular to said open exit face; and a base substantially parallel to and separated from said open exit face by a channel depth;

a source of electrons external and proximate to said channel exit face, said electrons undergoing open electron drift within said channel in a direction substantially parallel to said channel length, under the combined influence of said orthogonal electric and magnetic fields; and a source of neutral particles proximate to said base, said neutral particles entering said channel and undergoing collisions with said electrons, whereby a portion of said neutral particles are ionized by said collisions.

2. The thruster of claim 1, wherein said channel walls comprise an electrically insulating material.

3. The thruster of claim 2, wherein said electronically insulating material is alumina.

4. The thruster of claim 2, wherein said electrically insulating material has lower secondary electron emission properties than does alumina.

5. The thruster of claim 4, wherein said electronically insulating material is boron nitride.

6. The thruster of claim 1, wherein the values of said electric and magnetic fields and of aspect ratios between channel length and channel depth are selected in accordance with a scaling methodology.

7. The thruster of claim 1, wherein said neutral particles are xenon atoms.

8. The thruster of claim 1, further comprising a plurality of said substantially linear channels, each of said channels having a length mutually perpendicular to orthogonal electric and a magnetic fields, an open exit face extending substantially the length of each of said channels, walls extending perpendicular to said open exit faces, and a base substantially parallel to and separated from said open exit face by a channel depth, said plurality of channels comprising at least one source of electrons external and proximate said channel exit faces, said electrons undergoing open electron drift within each channel in a direction substantially parallel to said channel length, under the combined influence of said orthogonal electric and magnetic fields, and each said channel comprising a source of neutral particles proximate to said base, said neutral particles entering said channel and undergoing collisions with said electrons, whereby a portion of said neutral particles are ionized by said collisions.

9. The thruster of claim 8, wherein said plurality of linear channels are disposed in a modular array such that the lengths of said channels are parallel to one another and such that the polarity of the magnetic field is reversed between adjacent channels.

10. The thruster of claim 1, wherein said magnetic field is provided by a permanent magnet.

11. A method of propulsion, comprising:

providing a vacuum environment having a background pressure less than approximately $10^{-4}$ Torr;

providing a plasma thruster having:

an electric field oriented parallel to a first axis;

a magnetic field oriented substantially orthogonal to the electric field;

a substantially linear channel having:

a length mutually orthogonal to said electric and magnetic fields;

an open exit face extending substantially said length of said channel;

walls extending perpendicular to said open exit face; and a base substantially parallel to and separated from said open exit face by a channel depth;

a source of electrons external and proximate to said channel exit face, said electrons undergoing open electron drift within said channel in a direction substantially parallel to said channel length, under the combined influence of said orthogonal electric and magnetic fields; and a source of neutral particles proximate to said base, said neutral particles entering said channel and undergoing collisions with said electrons, whereby a portion of said neutral particles are ionized by said collisions.

12. The method of claim 11, wherein said ionized particles are accelerated out of said discharge channel through said open exit face by said electric field.

13. The method of claim 12, wherein said accelerated ionized particles combine with electrons to form neutral particles, thereby providing a neutral propellant.

14. The method of claim 13, further comprising providing a plurality of said plasma thrusters in a modular array having a plurality of linear channels, disposed such that said lengths of said plurality of linear channels are parallel to one another and such that the polarity of the magnetic field is reversed between adjacent channels.

15. The method of claim 14, wherein individual plasma thrusters are selectively turned on and off, thereby changing the thrust level of said modular array.

16. The method of claim 11, wherein said neutral particles are xenon atoms.

17. The method of claim 11, wherein said magnetic field is provided by a permanent magnet.

* * * * *